US010938122B2

(12) United States Patent
Miragliotta et al.

(10) Patent No.: US 10,938,122 B2
(45) Date of Patent: Mar. 2, 2021

(54) ANTENNA INCORPORATING A METAMATERIAL

(71) Applicant: The Johns Hopkins University, Baltimore, MD (US)

(72) Inventors: Joseph A. Miragliotta, Ellicott City, MD (US); Kenneth R. Grossman, Olney, MD (US)

(73) Assignee: The Johns Hopkins University, Baltimore, MD (US)

( * ) Notice: Subject to any disclaimer, the term of this patent is extended or adjusted under 35 U.S.C. 154(b) by 78 days.

(21) Appl. No.: 16/554,819

(22) Filed: Aug. 29, 2019

(65) Prior Publication Data

US 2020/0203850 A1 Jun. 25, 2020

Related U.S. Application Data

(60) Provisional application No. 62/781,653, filed on Dec. 19, 2018.

(51) Int. Cl.

| | |
|---|---|
| ***H01Q 21/06*** | (2006.01) |
| ***H01Q 9/04*** | (2006.01) |
| ***H01Q 1/48*** | (2006.01) |
| ***H01Q 15/00*** | (2006.01) |

(52) U.S. Cl.
CPC ..... *H01Q 21/065* (2013.01); *H01Q 1/48* (2013.01); *H01Q 9/0407* (2013.01); *H01Q 15/0086* (2013.01)

(58) Field of Classification Search
None
See application file for complete search history.

(56) References Cited

U.S. PATENT DOCUMENTS

| | | | | |
|---|---|---|---|---|
| 2019/0326680 | A1* | 10/2019 | Williams | H01Q 19/06 |
| 2020/0044326 | A1* | 2/2020 | Olfert | H01Q 21/061 |
| 2020/0274245 | A1* | 8/2020 | Shrekenhamer | H01Q 1/422 |

* cited by examiner

*Primary Examiner* — Jany Richardson
(74) *Attorney, Agent, or Firm* — Noah J. Hayward

(57) ABSTRACT

An antenna includes a top plate having a top side and a bottom side, a ground plate disposed parallel to the top plate, a ground pin connecting the top plate to the ground plate, and a probe pin connected to the bottom side of the top plate. The probe pin is configured to be connected to a signal source. The antenna further includes a first dielectric layer adjacent to the bottom side of the top plate, and a first patterned conductor layer adjacent to the first dielectric layer. The first dielectric layer is disposed between the top plate and the first patterned conductor layer. The top plate is separated from the ground plate by a distance.

20 Claims, 12 Drawing Sheets

12

12

12

ANTENNA INCORPORATING A METAMATERIAL

CROSS-REFERENCE TO RELATED APPLICATIONS

This United States Nonprovisional Patent Application claims the benefit of and relies for priority upon U.S. Provisional Patent Application Ser. No. 62/781,653, filed on Dec. 19, 2018, the entire content of which is incorporated herein by reference.

STATEMENT OF GOVERNMENTAL INTEREST

This invention was made with Government support under contract number N00024-13-D-6400 awarded by the Naval Sea Systems Command (NAVSEA). The Government has certain rights in the invention.

BACKGROUND

This disclosure relates generally to antennas. More particularly, the present invention concerns the construction of antennas incorporating one or more metamaterials.

Conventional antennas suffer from a number of deficiencies. For example, existing monopole antennas cannot be placed parallel in proximity with a conductive surface, and therefore cannot be conformal. Additionally, previous attempts at creating low-profile antennas have resulted only in antennas that either do not reproduce a monopole radiation pattern with acceptable fidelity or are significantly thicker than is required.

A desire has arisen, therefore, for an improved antenna that addresses one or more of the deficiencies identified herein.

BRIEF SUMMARY

Non-limiting, example embodiments of the disclosed invention include, but are not limited to, an antenna having a metamaterial included therein. More particularly, the antenna includes a top plate having a top side and a bottom side, a ground plate disposed parallel to the top plate, a ground pin connecting the top plate to the ground plate, and a probe pin connected to the bottom side of the top plate. The probe pin is configured to be connected to a signal source. The antenna further includes a first dielectric layer adjacent to the bottom side of the top plate, and a first patterned conductor layer adjacent to the first dielectric layer. The first dielectric layer is disposed between the top plate and the first patterned conductor layer. The top plate is separated from the ground plate by a distance.

Further details of these and other aspects of the subject matter of the present invention will be apparent from the detailed description and drawings included below.

BRIEF DESCRIPTION OF THE DRAWINGS

Reference is now made to the accompanying drawings, in which.

DETAILED DESCRIPTION

Figure 1:
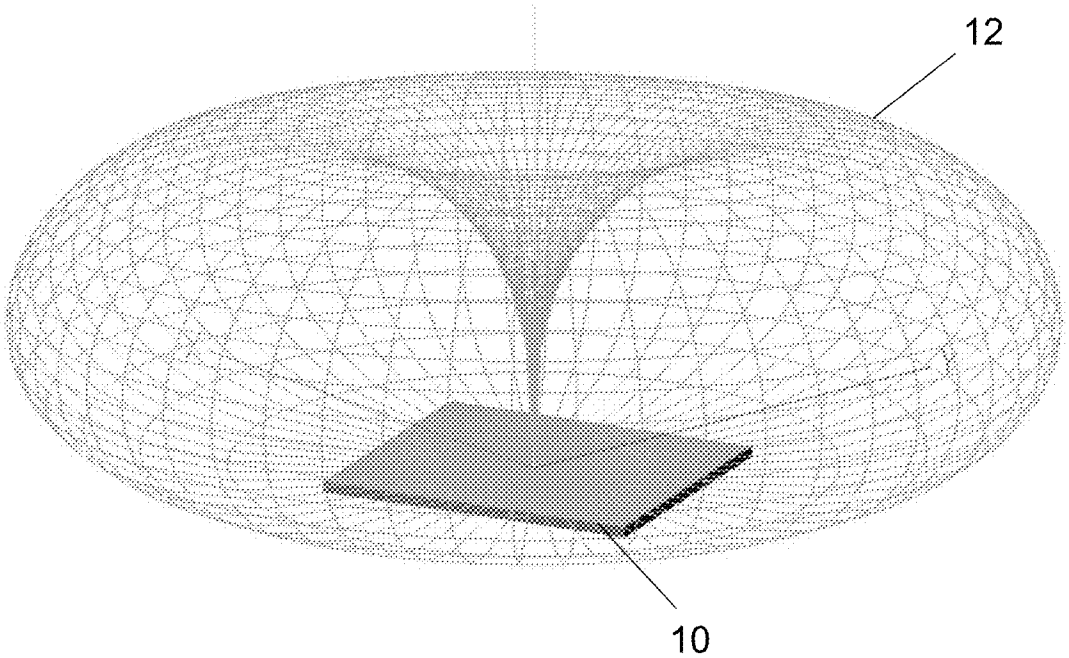
FIG. 1 is a perspective illustration of an antenna according to an example embodiment, showing the radiation pattern for the antenna.

One or more non-limiting, example embodiments will now be described in additional detail. The embodiments are intended to illustrate the breadth and scope of the present invention rather than to limit the scope thereof.

Before describing specific details associated with an antenna 10, a few general parameters are first discussed. Specifically, the antenna 10 is of a type often referred to as a "top hat" antenna. The antenna 10 is designed to present an exceptionally low profile. In addition, the antenna 10 operates to provide a monopole radiation pattern despite the fact that the antenna 10 has a top hat configuration.

As is apparent to those skilled in the art, existing, common monopole antennae stand approximately ¼ wavelength ($\lambda$) tall above the ground-plane. The antenna 10 according to example embodiments of the present invention, however, has a much smaller height while retaining acceptable—and even improved—performance characteristics. More particularly, heights of the antenna 10 according to some example embodiments range from about $1/40\lambda$ to about $1/55\lambda$. In one specific example embodiment, the height is about $1/50\lambda$, while delivering exceptional efficiency and monopole radiation pattern fidelity.

To achieve a compact design, the antenna 10 incorporates one or more materials that are commonly referred to as "metamaterials," the details of which are discussed in the paragraphs that follow. Metamaterials incorporate shaped conductors that enhance one or more operational properties of the antenna 10.

The antenna 10 incorporates one or more metamaterials to provide a top hat monopole antenna architecture. The metamaterials facilitate a reduction in both lateral size and height of the antenna 10 by comparison with a traditional antenna structure. The performance of the antenna 10, however, is not negatively impacted.

The antenna 10 is anticipated to operate in the ultra high frequency (UHF) microwave frequency band. However, the antenna 10 may be modified to operate at other communication frequencies such as very high frequency (VHF), s-band, x-band, or Ku-band, for example.

Some advantages of the antenna 10 are listed herein. The antenna 10 is able to perform transmitter/receiver (Tx/Rx) operations when placed flat on a metal surface. The operational band of the antenna 10 is in the UHF band, i.e., between 300 megahertz (MHz) and 3 gigahertz (GHz). In one example embodiment, the antenna 10 operates in a frequency band from 400 to 550 MHz, and in another example embodiment, the antenna 10 operates in a frequency band from 450 to 510 MHz. though alternative example embodiments are not limited to the foregoing.

A radiation pattern 12 of the antenna 10 is omni-directional at low elevation. The antenna 10 exhibits a far field profile that is consistent with a whip antenna, also referred to as a monopole antenna. The size of the antenna 10 is electrically small. The antenna 10 may operate in all types of weather conditions including rain, snow, fog, high temperatures, and/or low temperatures.

FIG. 1 is a graphical representation of the antenna 10 according to one example embodiment. The antenna 10 operates omni-directionally, as indicated by the radiation pattern 12 shown in FIG. 1.

Figure 2:
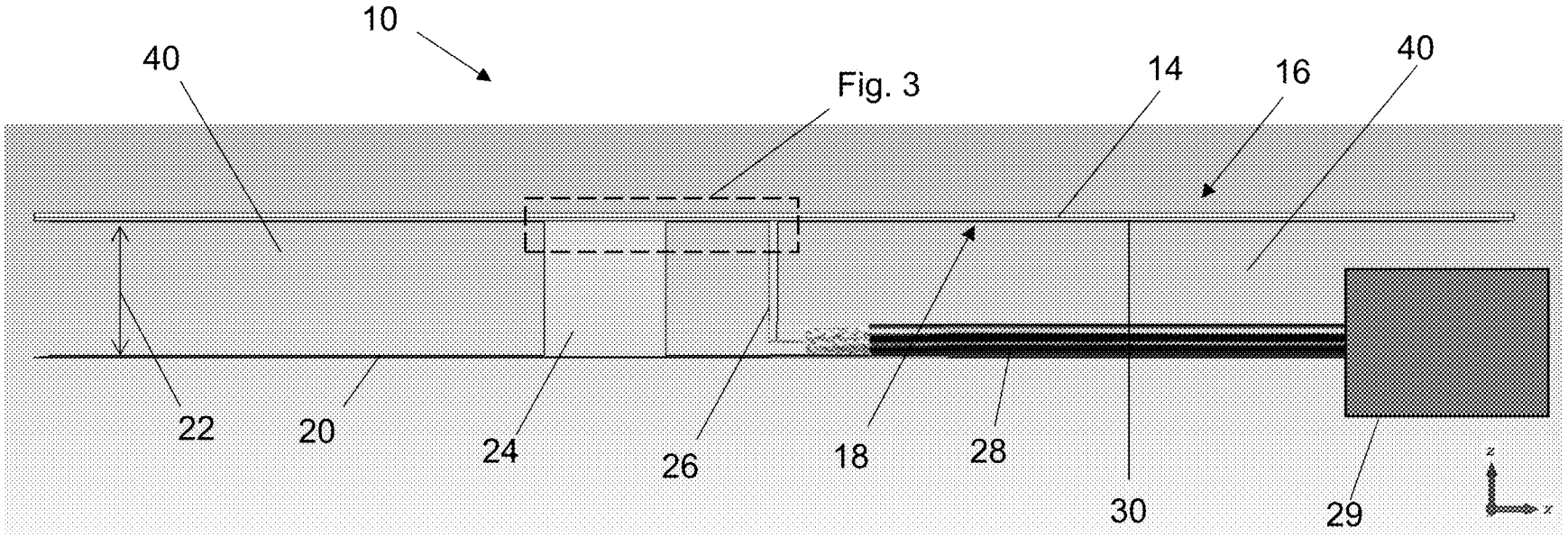
FIG. 2 is a cross-sectional, graphical side view of the antenna illustrated in FIG. 1.

FIG. 2 is a cross-sectional graphical representation of an example embodiment of the antenna 10 illustrated in FIG. 1.

The antenna 10 includes a top plate 14 with a top side 16 and a bottom side 18 (as viewed in FIG. 2). For reference, x- and z-axes are provided in this illustration. The antenna 10 also includes a ground plate 20 that is disposed parallel to, e.g., facing, the top plate 14. The ground plate 20 is separated from the top plate 14 by a distance 22 extending along the z-axis. The distance 22 may be determined by the operating frequency band of the antenna 10 and, in some non-limiting example embodiments, ranges from about 1.0 centimeters (cm) to about 2.0 cm. In one non-limiting specific example embodiment, the distance 22 is about 1.5 cm, but alternative example embodiments are not limited thereto. As illustrated in FIG. 2, a ground pin 24 connects the top plate 14 to the ground plate 20, physically and conductively. In addition, a probe pin 26 is connected to the bottom side 18 of the top plate 14. The probe pin 26 is connected to a coaxial cable 28, which is configured, e.g., is physically and/or electrically arranged, to connect to a signal source 29, which in some example embodiments may be or include a signal processor. More particularly, in one example embodiment, the probe pin 26 is connected to the center conductor of the coaxial cable 28 (the shield of the coaxial cable 28 being connected to the ground plate 20), such that the probe pin 26 is perpendicular to the top plate 14, runs toward the ground plate 20, and is electrically isolated from the ground plate 20; accordingly, the probe pin 26 acts as the radiating element of the antenna 10. The antenna 10 includes a metamaterial disposed on or adjacent to the bottom side 18 of the top plate 14, as will now be described in greater detail with reference to FIG. 3.

Figure 3:
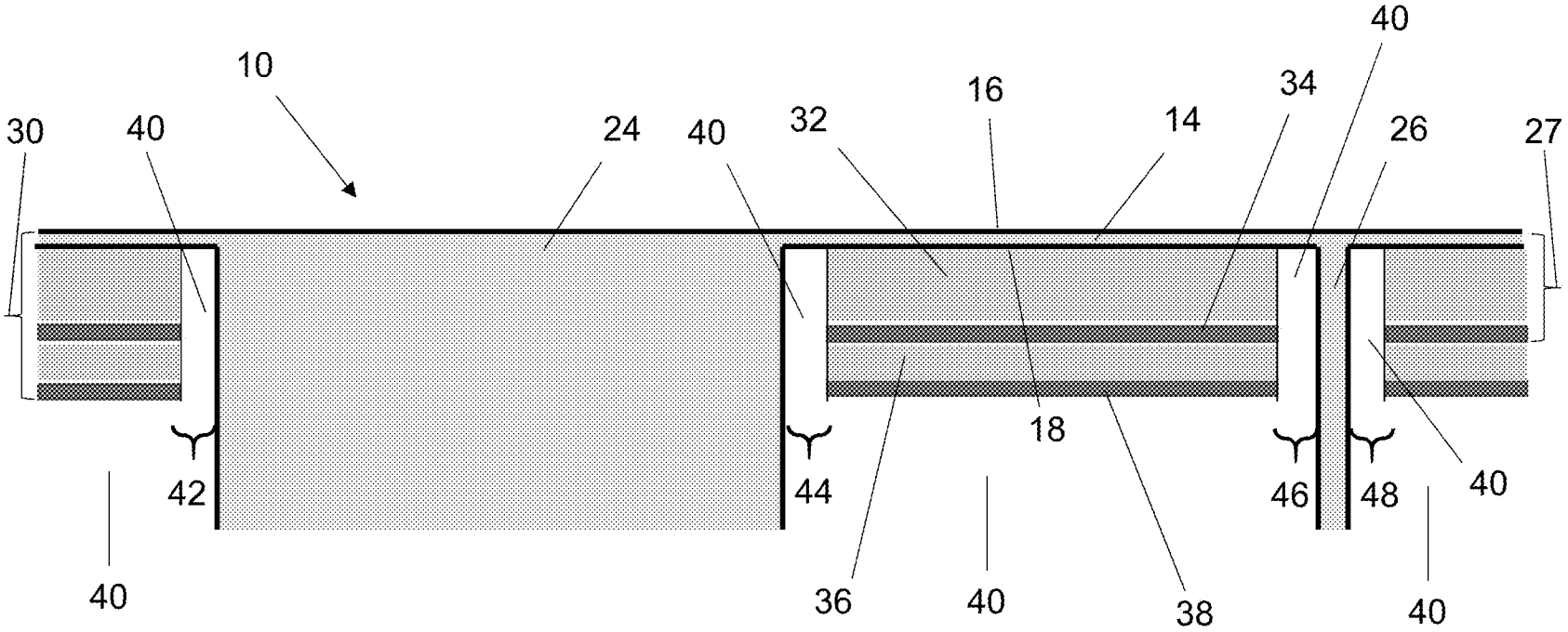
FIG. 3 is an enlarged partial cross-section of the antenna illustrated in FIG. 2, where the enlargement is of the area designated in FIG. 2 as "FIG. 3;"

FIG. 3 is an enlarged view of a portion of the antenna 10 illustrated in FIG. 1. Specifically, FIG. 3 is an enlarged view of the portion of the antenna 10 that is encompassed by the dotted-line box in FIG. 2 labeled "FIG. 3."

Generally speaking, metamaterials according to example embodiments include a dielectric layer placed on the top plate 14, with a patterned conductor layer placed on the dielectric layer. Additional embodiments include "layers" of alternating dielectric and patterned conductor layers "stacked" on the top plate 14. More particularly, the top plate 14, the dielectric layer, and the patterned conductor layer (or the "stacked" pairs of dielectric and patterned conductor layers) form an artificial high-impedance metamaterial.

More specifically, as shown in FIG. 3, an artificial high-impedance metamaterial 27 according to an example embodiment includes a first dielectric layer 32 positioned adjacent to the bottom side 18 of the top plate 14, with a first patterned conductor layer 34 positioned adjacent to the first dielectric layer 32, such that the first dielectric layer 32 is disposed between the top plate 14 and the first patterned conductor layer 34.

A metamaterial 30 according to an alternative example embodiment includes a second dielectric layer 36 and a second patterned conductor layer 38, arranged as shown in FIG. 3. More specifically, the second dielectric layer 36 is disposed adjacent to the first patterned conductor layer 34, and the second dielectric layer 36 separates the first patterned conductor layer 34 from the second patterned conductor layer 38. Thus, the top plate 14, the first and second dielectric layers 32 and 36, and the first and second patterned conductor layers 34 and 38 form the artificial high-impedance metamaterial 30.

It is noted that the antenna 10 according to one example embodiment includes only the artificial high-impedance metamaterial 27. The artificial high-impedance metamaterial 30 is provided as an alternative example embodiment, in which the operational characteristics of the antenna 10 may be adjusted. Thus, the second patterned conductor layer 38 and the second dielectric layer 36 are not required to construct the antenna 10 according to some example embodiments. Still further, if required or desired, additional layers of alternated dielectric and patterned conductor may be added without departing from the scope of the present invention. Following the construction pattern illustrated in FIG. 3, adjacent additional ones of the patterned conductor layers are separated from each other by corresponding additional dielectric layers, consistent with the layered pattern described ad shown herein.

Referring again to FIG. 2, the antenna 10 may also include an additional dielectric layer or material, e.g., a third dielectric layer 40, disposed between the ground plate 20 and either (or both) the top plate 14 and the metamaterial 30. In one non-limiting example embodiment, the third dielectric layer 40 extends from the bottom (as viewed in FIGS. 2 and 3) of the metamaterial 30 to the top of the ground plate 20, as well as from the bottom side 18 of the top plate 14 to the top of the ground plate 20. Thus, in this example embodiment, the third dielectric layer 40 fills the void established by the distance 22 between the top plate 14 and the ground plate 20, as well as the void established between the metamaterial 30, disposed on the top plate 14, and the ground plate 20.

In one example embodiment, the third dielectric layer 40 is air. However, any other dielectric material, such as porous foam, may be employed without departing from the scope of the present invention. The distance 22 between the metamaterial 30 and the ground plate 20 is contemplated to be approximately $1/50\lambda$.

As shown in FIG. 3, electrical isolation is provided to the ground pin 24 and the probe pin 26 by annular openings (e.g., insulation/insulators) around the ground pin 24 and the probe pin 26. Shown in two dimensions in FIG. 3, these annular openings appear as gaps 42, 44, 46, 48. The annular openings/gaps 42, 44, 46, 48 are filled with the third dielectric layer 40. In one example embodiment, the annular openings/gaps 42, 44, 46, 48 are filled with air as the third dielectric layer 40. However, other dielectric materials may be employed. It is also possible that one or more of the materials forming the first dielectric layer 32 and/or the second dielectric layer 36 may fill the annular openings/gaps 42, 44, 46, 48.

The top plate 14, the ground plate 20, the ground pin 24, and the probe pin 26 are all contemplated to be made from a conductive material, also referred to herein as a conductor. While the conductive material may be a metal, such as copper or aluminum, the conductive material need not be a metal. Any suitable conductor may be employed without departing from the scope of the present invention.

Figure 4:
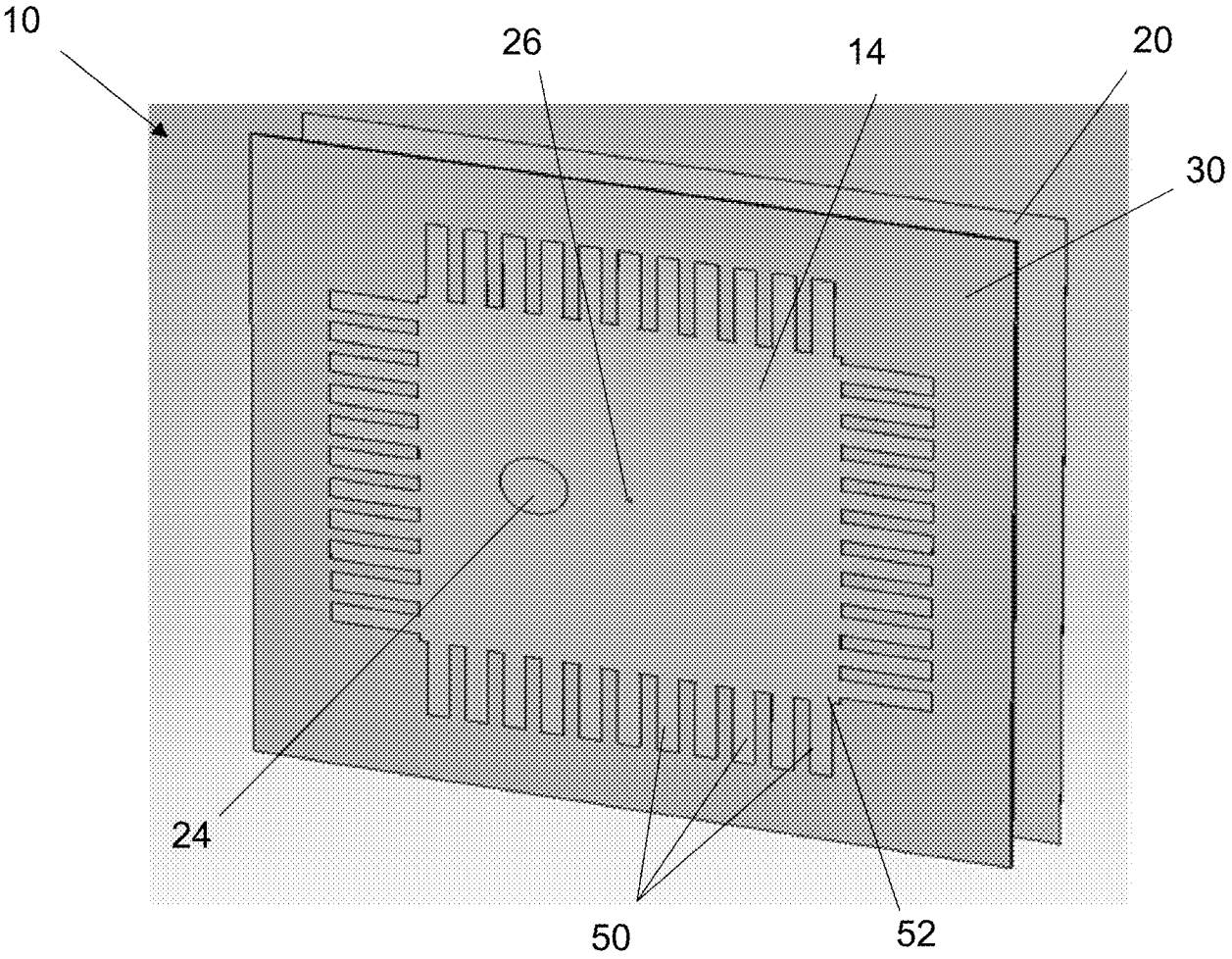
FIG. 4 is a perspective, graphical illustration of various elements of the antenna shown in FIG. 1.

FIG. 4 is a perspective, graphical illustration of various aspects of the antenna 10 illustrated in FIGS. 1-3. This view shows the top plate 14 adjacent to the metamaterial 30. The ground plate 20 is disposed behind (as viewed in FIG. 4) the top plate 14 and the metamaterial 30. Specifically, the metamaterial 30 is disposed between the top plate 14 and the ground plate 20.

FIG. 4 also illustrates one further feature incorporated into the top plate 14. In particular, in an example embodiment, the top plate 14 includes, or is formed to include, a plurality of protrusions 50 extending outwardly from a periphery 52 of the top plate 14 such that the protrusions 50 and the top plate 14 are a continuous conductor.

FIGS. 5-8 illustrate various aspects of an example embodiment of the antenna 10.

Figure 5:
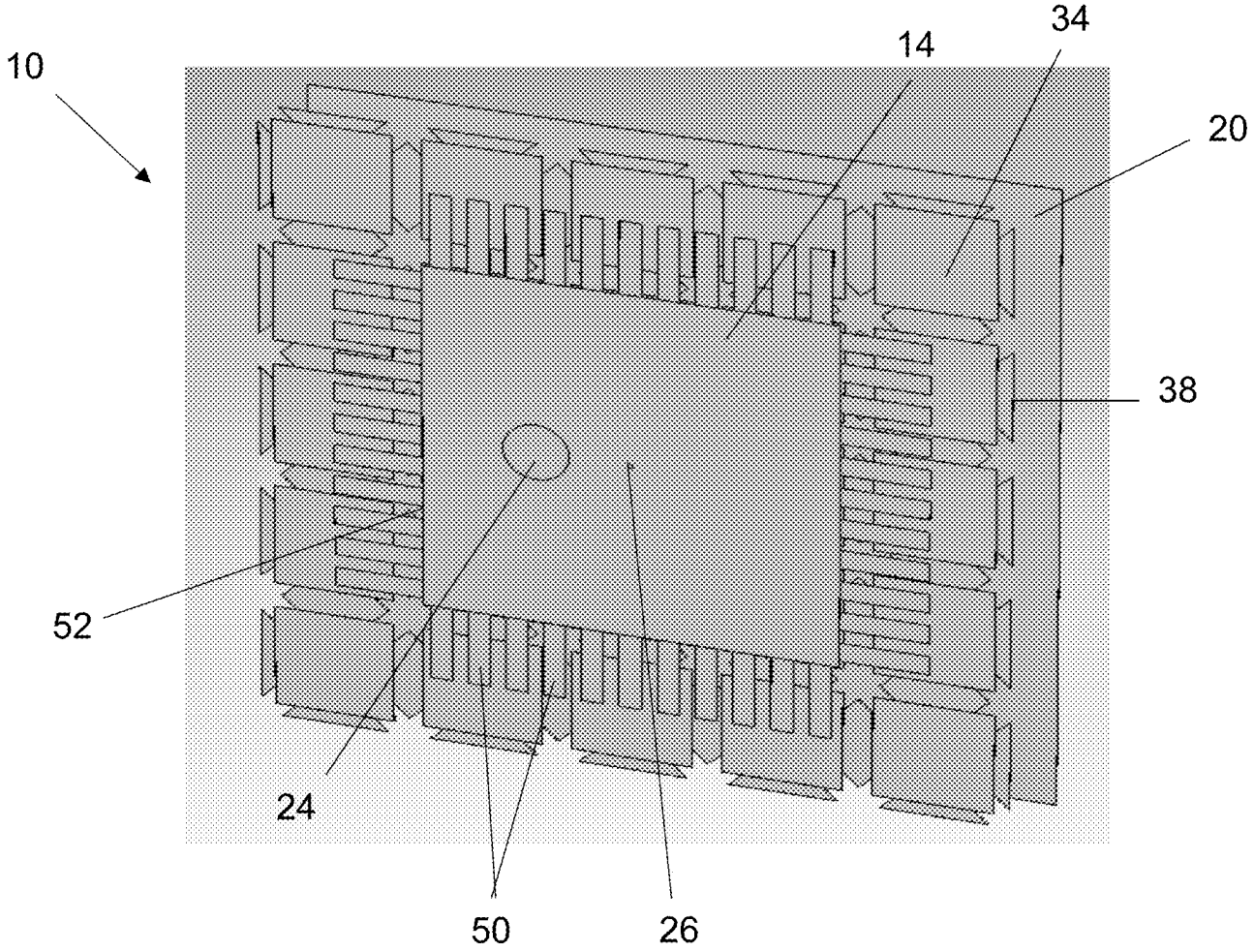
FIG. 5 is a perspective, graphical illustration of further features and elements of the antenna depicted in FIG. 1.

FIG. 5 is a perspective, graphical illustration of the four conductive layers of the antenna 10 according to an example embodiment. For clarity, the four conductive layers are identified as the top plate 14, the first patterned conductor layer 34, the second patterned conductor layer 38, and the ground plate 20. The first dielectric layer 32, the second dielectric layer 36, and the third dielectric layer 40 are omitted from this view for purposes of illustration of the other components.

Figure 6:
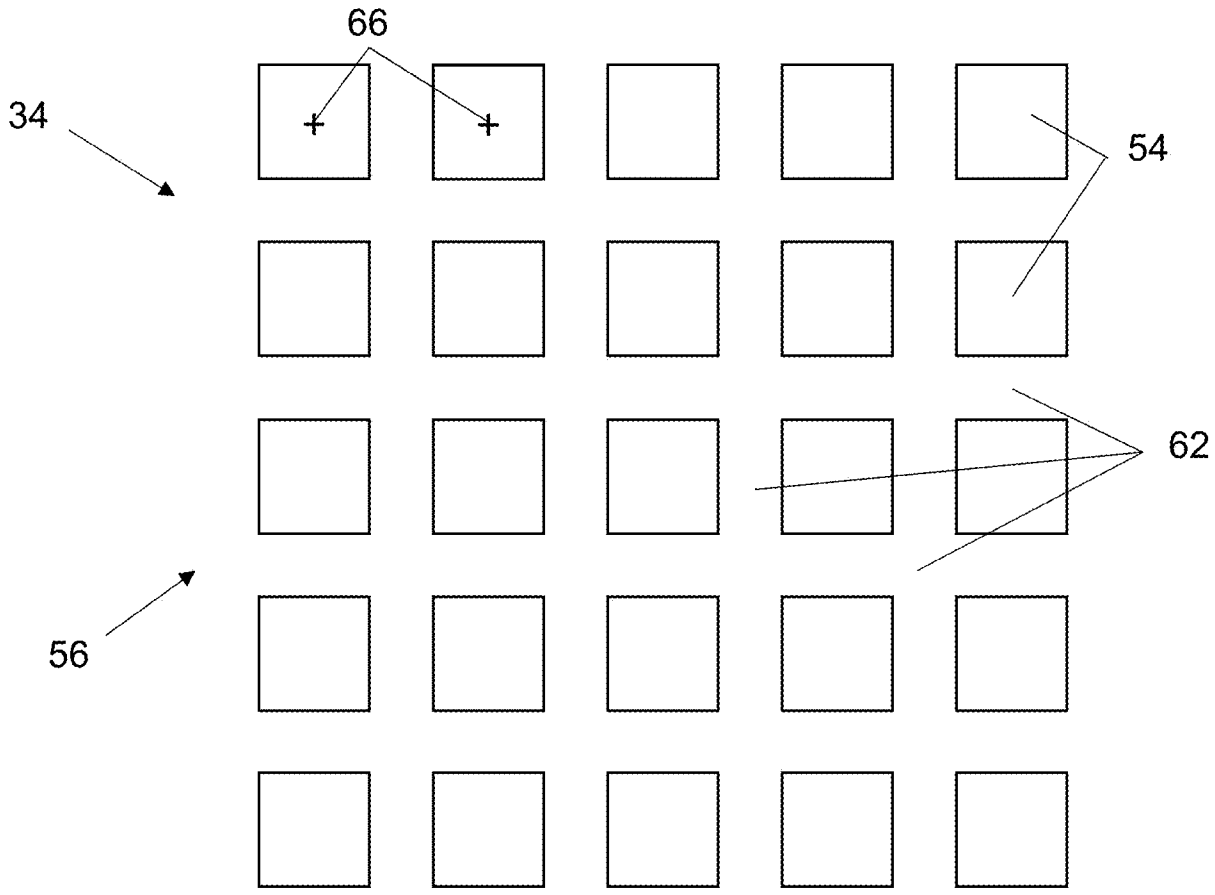
FIG. 6 is a graphical, top view of a first pattern of first conductive elements forming a first artificial high-impedance layer.

FIG. 6 is a graphical, top view of the first patterned conductor layer 34. The first patterned conductor layer 34 includes a plurality of first conductive elements 54, arranged in first pattern 56. First conductive elements 54 of the plurality of first conductive elements 54 are made of a conductive material and are separated from one another by first interstices 62.

Figure 7:
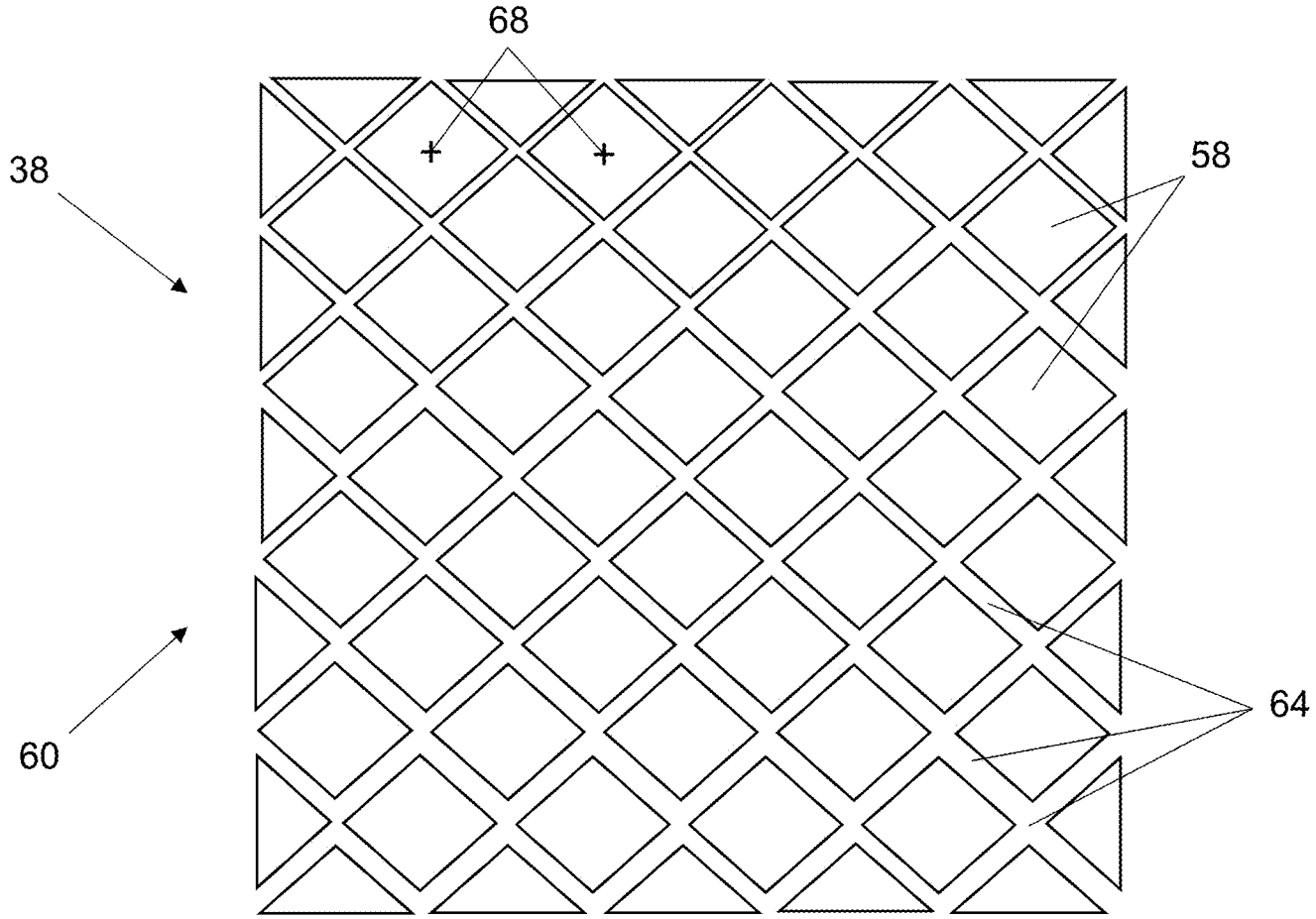
FIG. 7 is a graphical, top view of a second pattern of second conductive elements forming a second artificial, high impedance layer.

FIG. 7 is a graphical, top view of the second patterned conductor layer 38. The second patterned conductor layer 38 includes a plurality of second conductive elements 58. Second conductive elements 58 of the plurality of second conductive elements 58 also are made from a conductive material and are arranged in a second pattern 60. In a similar manner as with the first conductive elements 54, the second conductive elements 58 are separated from one another by second interstices 64.

Figure 8:
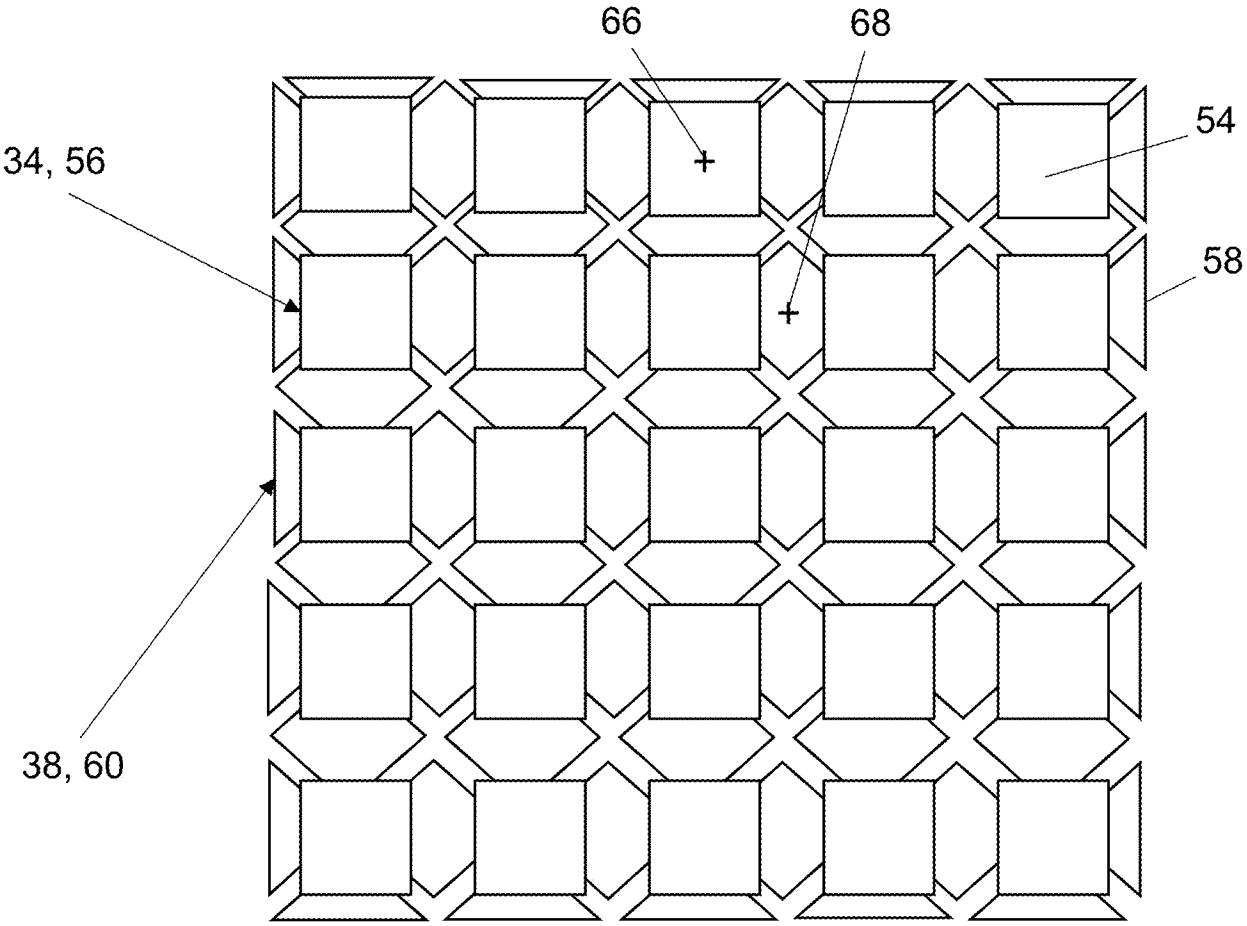
FIG. 8 is a graphical, top view of the first pattern of the first conductive elements atop the second pattern of the second conductive elements consistent with elements of the antenna illustrated in FIG. 5.

FIG. 8 is a graphical, top view of the first pattern 56 of the plurality of first conductive elements 54 atop the second pattern 60 of the plurality of second conductive elements 58 consistent with the antenna 10 illustrated in FIG. 5. The first dielectric layer 32 and the second dielectric layer 36 are omitted from the view in FIG. 8 so that the relationship between the first pattern 56 of the plurality of first conductive elements 54 and the second pattern 60 of the plurality of second conductive elements 58 may be more readily appreciated.

Returning to FIG. 5, the four layers of the antenna 10 are shown in the order, from top to bottom along the distance 22 in the z-axis illustrated in FIG. 2, in which the layers are contemplated to be stacked to form the antenna 10. The top plate 14 is visible adjacent to the first patterned conductor layer 34. The first patterned conductor layer 34 can be seen adjacent to the second patterned conductor layer 38 such that the first patterned conductor layer 34 is sandwiched between the top plate 14 and the second patterned conductor layer 38. The second patterned conductor layer 38 is adjacent to the ground plate 20 such that the second patterned conductor layer 38 is sandwiched between the first patterned conductor layer 34 and the ground plate 20. As illustrated in FIG. 2, the second patterned conductor layer 38 is separated from the ground plate 20 by slightly less than the distance 22, since the first and second dielectric layers 32 and 36 (not visible in FIG. 5) and the first and second patterned conductor layers 34 and 38 included in the metamaterial or 30 are disposed on the top plate 14.

As noted above, each first conductive element 54 is made of a conductive material. While one contemplated conductive material is a metal, such as copper, any other type of conductor may be employed. Similarly, each second conductive element 58 also is made of a conductive material. And, while a metal, such as copper, may be used, any other type of conductor may be employed.

As illustrated in FIG. 6, the first pattern 56 includes the first conductive elements 54, which may be in the shape of rectangles or squares. Similarly, as shown in FIG. 7, the second pattern 60 includes second conductive elements 58, which may also be in the shape of rectangles or squares.

In the illustrated example embodiment, the second pattern 60 differs from the first pattern 56 in that the second conductive elements 58 are rotated 45° with respect to the first conductive elements 54, although alternative example embodiments are not limited thereto.

As also illustrated in FIGS. 6 and 7, the centers 66 of the first conductive elements 54 are offset from the centers 68 of the second conductive elements 58. This offset arrangement is more clearly illustrated in FIG. 8, where the first pattern 56 is shown disposed above the second pattern 60.

As also illustrated in FIGS. 6 and 7, the first conductive elements 54 are separated from one another via the first interstices 62. Similarly, the second conductive elements 58 also are separated from one another via the second interstices 64. Thus, the first interstices 62 and the second interstices 64 are spaces between the first conductive elements 54 and the second conductive elements 58, respectively, so that individual ones of the first conductive elements 54 and the second conductive elements 58 do not touch one another and, therefore, are conductively isolated from one another. In an example embodiment, the first interstices 62 and the second interstices 64 are occupied by a dielectric material. In one example embodiment, the dielectric material in the first interstices 62 and the second interstices 64 is the same material employed for the first dielectric layer 32 and/or the second dielectric layer 36. Alternatively, it is contemplated that the first interstices 62 and the second interstices 64 may be filled with air, which may also be the material filling the third dielectric layer 40 shown in FIGS. 2 and 3. As should be apparent, another dielectric material may be employed without departing from the scope of the present invention.

In an example embodiment, the metamaterial 30 interacts with one or both of the top plate 14 and the ground plate 20 to enhance the radiation pattern 12 for the antenna 10 so that the antenna simulates the behavior of a monopole antenna with excellent transmission and reception properties. This same arrangement of elements also contributes to the small package size for the antenna 10.

For the antenna 10, the first conductive elements 54 interact with the protrusions 50 on the periphery 52 of the top plate. The first conductive elements 54 also interact with the second conductive elements 58. And, similarly, the second conductive elements 58 interact with the first conductive elements 54 and the protrusions 50. Together, the protrusions 50, the first conductive elements 54, and the second conductive elements 58 modify the radiation pattern 12 so that the antenna 10 operates as a monopole antenna with exceptionally improved and unexpected performance, as will now be described and shown in further detail.

Figure 9:
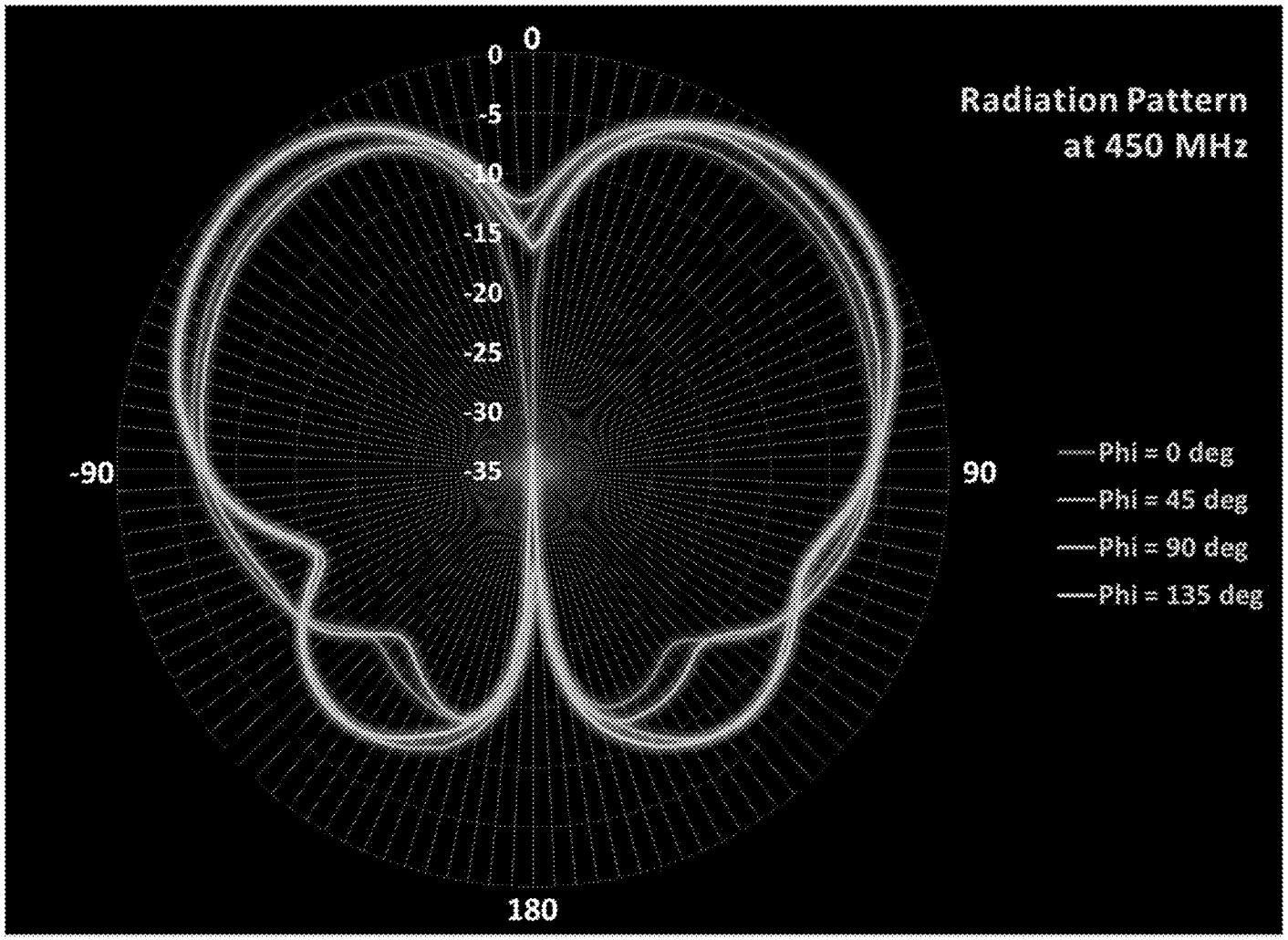
FIG. 9 is a radiation pattern for the antenna at 450 megahertz.
Figure 10:
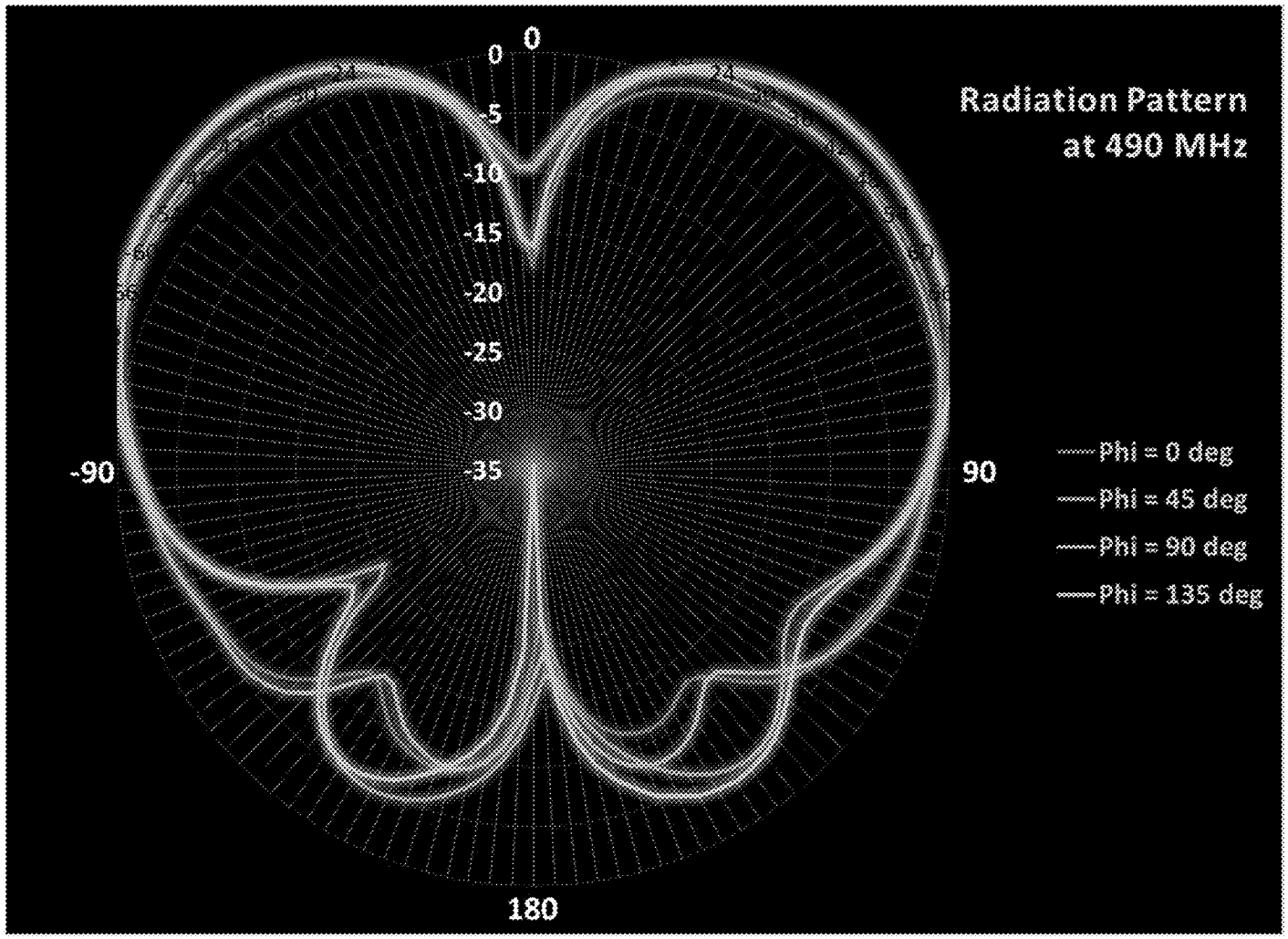
FIG. 10 is a radiation pattern for the antenna at 490 megahertz.
Figure 11:
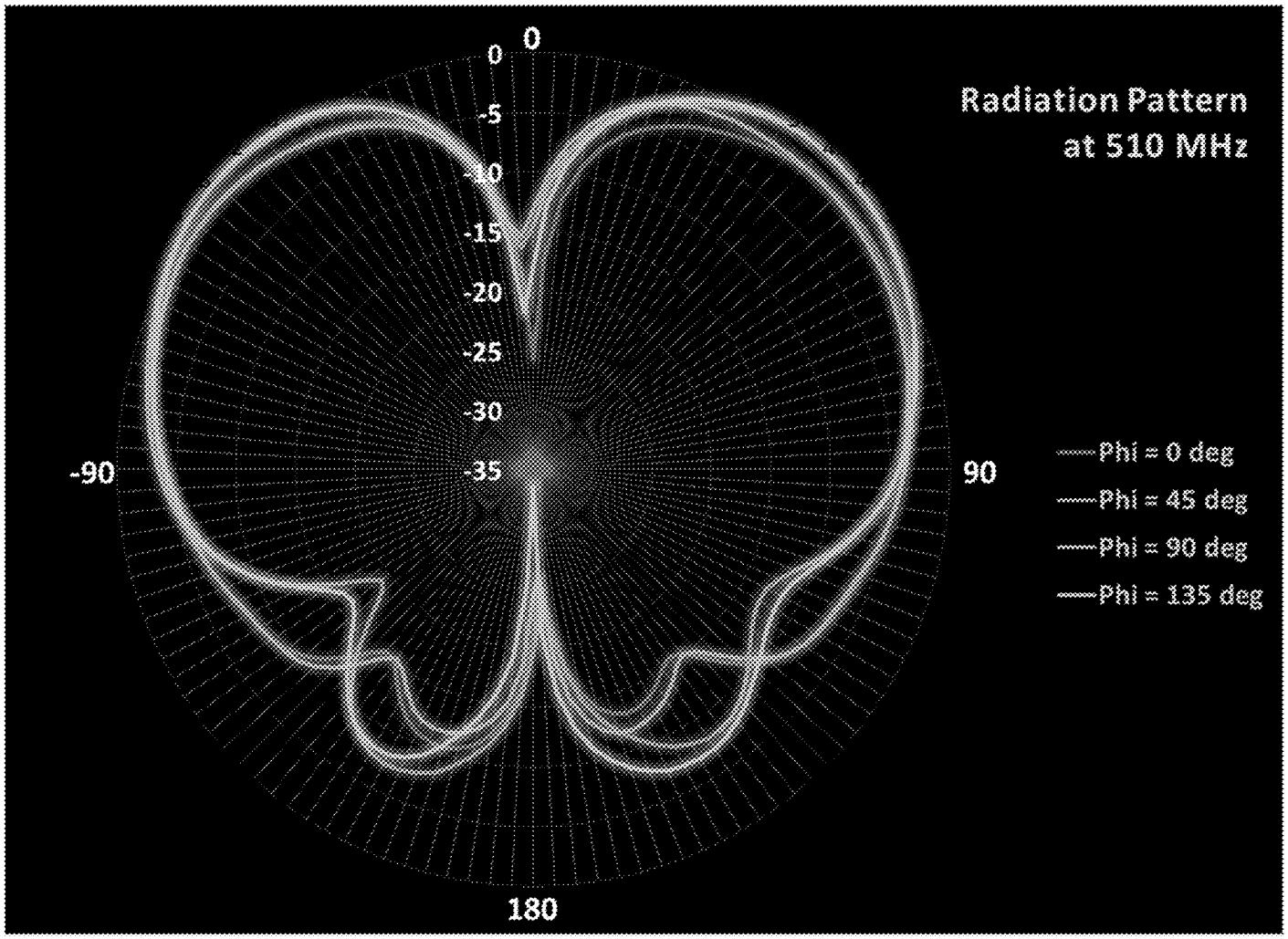
FIG. 11 is a radiation pattern for the antenna at 510 megahertz.

FIGS. 9-11 illustrate variations of a radiation pattern 12 for the antenna at different frequencies and azimuth angles phi (Φ) to illustrate the exceptional performance of the antenna 10 according to example embodiments.

FIG. 9 depicts the radiation pattern 12 for the antenna 10 as characterized in a spherical near-field (SNF) antenna test chamber at 450 MHz. At 450 MHz, the antenna 10 retains a monopole radiation pattern with very good efficiency. In particular, exceptional monopole performance and antenna efficiency were confirmed.

FIG. 10 also depicts the radiation pattern 12 for the antenna 10 as characterized in an SNF antenna test chamber at 490 MHz. At the center frequency of 490 MHz, the antenna 10 exhibits an exceptional efficiency with a near perfect monopole radiation pattern.

FIG. 11 also depicts the radiation pattern 12 for the antenna 10 as characterized in a SNF antenna test chamber at 510 MHz. At 510 MHz, the antenna 10 retains a monopole radiation pattern with very good efficiency.

Figure 12:
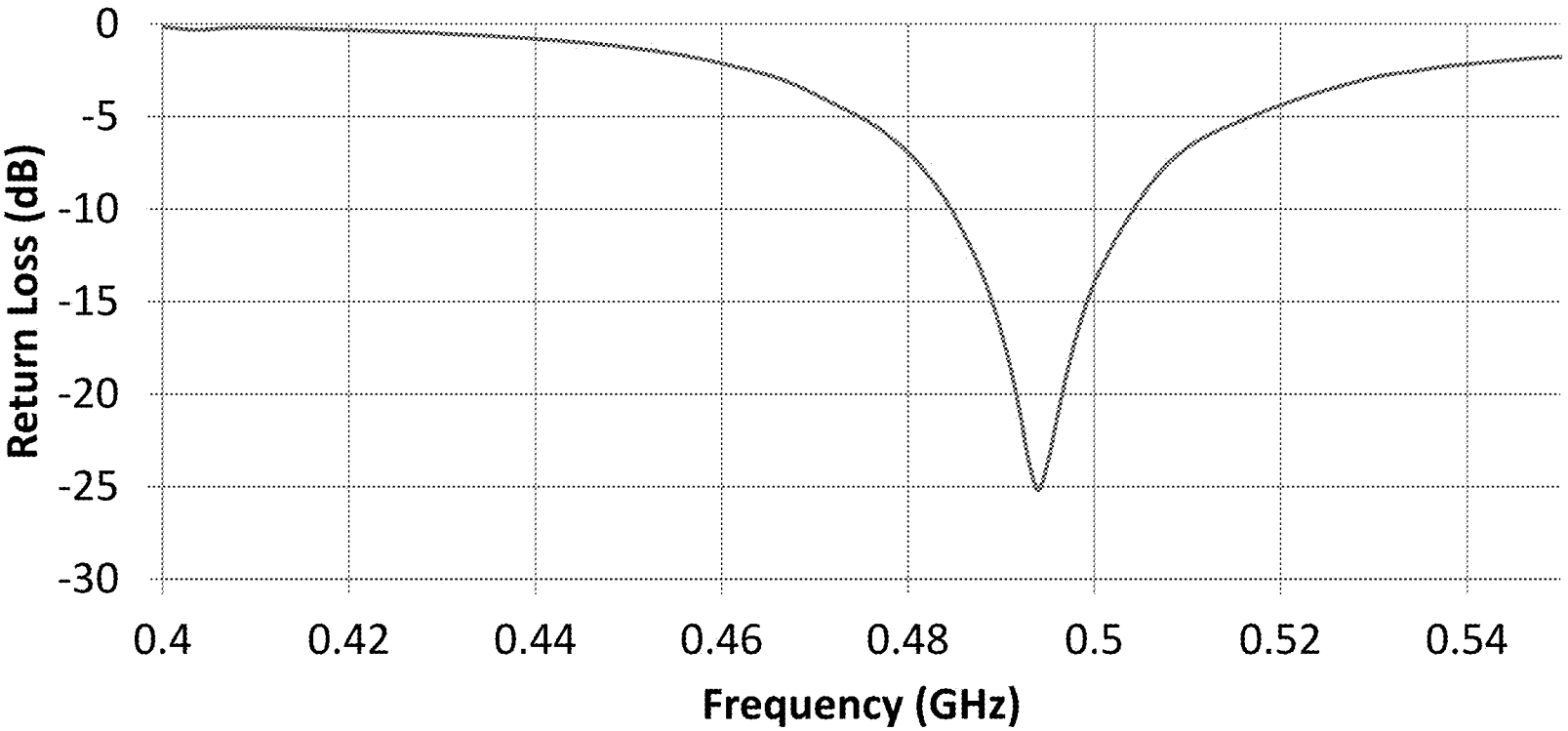
FIG. 12 is graph of return loss values for the antenna at various frequencies.

FIG. 12 depicts experimental results illustrating a return loss profile of the antenna 10 according to an example embodiment of the present invention, which plots return power loss in the antenna 10 against frequency. This plot of experimental data shows that greater than 99 percent (%) of the available source power is transferred to the antenna 10, which indicates that the antenna 10 according to at least one example embodiment is exceptionally well-balanced (from an electrical structural perspective). Coupled with the far-field data shown and described herein, the antenna 10 has been shown to have a greater than 95% radiative efficiency, which is a substantial improvement over existing antennas.

The above description is meant to be exemplary only, and those skilled in the art will recognize that changes may be made to the embodiments without departing from the scope of the present invention. Variations and equivalents to one or more aspects of the invention may employed without departing from the teachings of the present disclosure. Moreover, the present disclosure may be embodied in other specific forms without departing from the subject matter of the claims. Modifications, variations, and equivalents that fall within the scope of the present invention, as should be apparent to those skilled in the art, are intended to fall within the scope of the claims. Also, the scope of the claims is not intended to be limited by the embodiments set forth herein. Instead, the scope of the claims is intended to be given the broadest interpretation consistent with the description as a whole.

What is claimed is:

1. An antenna, comprising:

a top plate having a top side and a bottom side;

a ground plate disposed parallel to the top plate;

a ground pin connecting the top plate to the ground plate;

a probe pin connected to the bottom side of the top plate, wherein the probe pin is configured to be connected to a signal source;

a first dielectric layer disposed adjacent to the bottom side of the top plate; and a first patterned conductor layer disposed adjacent to the first dielectric layer, wherein the first dielectric layer is disposed between the top plate and the first patterned conductor layer, and wherein the top plate is separated from the ground plate by a distance.

2. The antenna of claim 1, further comprising:

a second dielectric layer disposed adjacent to the first patterned conductor layer; and a second patterned conductor layer disposed adjacent to the second dielectric layer, wherein the second dielectric layer is disposed between the first patterned conductor layer and the second patterned conductor layer.

3. The antenna of claim 2, further comprising a third dielectric layer disposed between the ground plate and at least one of the top plate and the second patterned conductor layer.

4. The antenna of claim 2, wherein the second patterned conductor layer comprises second conductive elements arranged in a second pattern, and the second conductive elements are separated from one another by second interstices.

5. The antenna of claim 4, wherein at least one of the second conductive elements is a conductor.

6. The antenna of claim 5, wherein the conductor comprises copper.

7. The antenna of claim 1, wherein the top plate is a conductor.

8. The antenna of claim 7, wherein the conductor comprises at least one of copper and aluminum.

9. The antenna of claim 1, wherein the ground plate is a conductor.

10. The antenna of claim 9, wherein the conductor comprises at least one of copper and aluminum.

11. The antenna of claim 1, further comprising a third dielectric layer disposed between the ground plate and at least one of the top plate and the first patterned conductor layer, wherein wherein the third dielectric layer comprises at least one of a porous foam and air.

12. The antenna of claim 1, wherein the distance has a value ranging from approximately 1/40 wavelength to 1/55 wavelength.

13. The antenna of claim 1, wherein the distance is approximately 1/50 wavelength.

14. The antenna of claim 1, wherein the first patterned conductor layer comprises first conductive elements arranged in a first pattern, and the first conductive elements are separated from one another by first interstices.

15. The antenna of claim 14, wherein at least one of the first conductive elements is a conductor.

16. The antenna of claim 15, wherein the conductor comprises copper.

17. The antenna of claim 14, wherein the first conductive elements are square-shaped.

18. The antenna of claim 17, further comprising:

a second dielectric layer disposed adjacent to the first patterned conductor layer; and a second patterned conductor layer disposed adjacent to the second dielectric layer, wherein the second dielectric layer is disposed between the first patterned conductor layer and the second patterned conductor layer, and the second patterned conductor layer comprises second conductive elements.

19. The antenna of claim 18, wherein the second conductive elements are square-shaped, are offset from the first conductive elements, and are rotated 45 degrees with respect to the first conductive elements.

20. The antenna of claim 1, wherein the top plate comprises protrusions extending outwardly from a periphery of the top plate.

* * * * *